US006578232B2

(12) United States Patent
Salice

(10) Patent No.: US 6,578,232 B2
(45) Date of Patent: Jun. 17, 2003

(54) FASTENING PLATE TO FASTEN A HINGE ARM OF A FURNITURE HINGE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 38 days.

(21) Appl. No.: 09/858,665

(22) Filed: May 17, 2001

(65) Prior Publication Data

US 2001/0047566 A1 Dec. 6, 2001

(30) Foreign Application Priority Data

May 24, 2000 (DE) ..... 200 09 317 U

(51) Int. Cl.[7] ..... E05D 7/04; A47B 97/00

(52) U.S. Cl. ..... 16/235; 16/254; 16/DIG. 43; 248/501

(58) Field of Search ..... 16/90, 235, 250, 16/242, 254, 404, DIG. 3, DIG. 43; 248/300, 346.03, 346.5, 501, 510

(56) References Cited

U.S. PATENT DOCUMENTS 4,554,706 A * 11/1985 Rock et al. ..... 16/237
4,785,497 A * 11/1988 Salice ..... 16/237
4,799,289 A * 1/1989 Grass ..... 16/236
4,800,622 A * 1/1989 Rock et al. ..... 16/240
4,800,625 A * 1/1989 Salice ..... 16/237
5,142,737 A * 9/1992 Ferrari et al. ..... 16/235
5,159,740 A * 11/1992 Brustle et al. ..... 16/258
5,603,142 A * 2/1997 Dubach et al. ..... 16/235
5,611,113 A * 3/1997 Rock et al. ..... 16/235
5,621,947 A * 4/1997 Fitz et al. ..... 16/240
5,819,371 A * 10/1998 Rock et al. ..... 16/258
5,966,779 A * 10/1999 Salice ..... 16/382
6,203,231 B1 * 3/2001 Salice ..... 16/237

FOREIGN PATENT DOCUMENTS

| | | |
|---|---|---|
| DE | 94 09 459.4 | 9/1994 |
| EP | 0 790 378 | 8/1997 |
| EP | 0 947 655 | 10/1999 |

* cited by examiner

*Primary Examiner*—Gary S. Hartmann
(74) *Attorney, Agent, or Firm*—Jacobson Holman PLLC

(57) ABSTRACT

The invention relates to a fastening plate to fasten a hinge arm of a furniture hinge to a carrier wall consisting of an elongated base plate having at least two boreholes to receive fastening elements, of a cover plate covering the base plate at least in part and being guided in a transversely displaceable manner thereon, and of an eccentric to displace the cover plate with respect to the base plate. In accordance with the invention, the base plate has in its central region at least one lower tang bent down through 180 degrees whose lateral edges are supported at the inner lateral edges of tangs bent down through 180 degrees at the cover plate.

18 Claims, 3 Drawing Sheets

FASTENING PLATE TO FASTEN A HINGE ARM OF A FURNITURE HINGE

BACKGROUND OF THE INVENTION

1. Field of the Invention

The invention relates to a fastening plate to fasten a hinge arm of a furniture hinge having an elongated base plate with at least two boreholes to receive fastening elements, a cover plate covering the base plate at least in part and being guided in a transversely displaceable manner thereon, and an eccentric to displace the cover plate with respect to the base plate.

2. Description of the Related Art

A generic fastening plate to fasten a hinge arm of a furniture hinge to a carrying wall is already known from DE 94 09 459 U. This consists of an elongated base plate having at least two boreholes to receive fastening elements, a cover plate covering the base plate at least in part and being guided in a transversely displaceable manner thereon and an eccentric to displace the cover plate with respect to the base plate. As the fastening screw for the hinge arm is located in the central region of the cover plate in this embodiment, the eccentric is offset and accessibly arranged by an appropriately arranged recess of the hinge arm. A symmetrical mounting of the fastening plate is thus not possible.

A vertically adjustable hinge having a fastening plate is known from EP 947655 A, wherein the eccentric is located at the intersection of the centre lines of the projecting centre piece and the lateral extensions of the cover plate, since in this case it is a clip hinge which does not require a fastening screw for the hinge arm. This symmetrical fastening plate has a cruciform shape. The assembly of the fastening plate from the individual components is particularly complex here.

A fastening plate made of steel and vertically adjustable by an eccentric is known from EP 790378, wherein the base plate is formed from two part plates which are located at sides of the projecting anchoring part of the cover plate opposite one another. The part plates are connected by a web beneath the projecting anchoring part in the mounting position, whereas lateral extensions of the cover plate are arranged beneath both part plates. Both plates can be held together by an additional bolt before the mounting of the fastening plate to the body side wall. This fastening plate also has a complex manufacturing process.

SUMMARY OF THE INVENTION

The object of the present invention consists of providing a symmetrical longitudinal fastening plate for fastening a hinge arm of a furniture hinge made of steel, which allows a simple vertical adjustment of clip hinges and can be manufactured particularly simply and at low cost.

This object is solved in accordance with the present invention by a fastening plate having an elongated base plate with at least two boreholes to receive fastening elements, a cover plate covering the base plate at least in part and being guided in a transversely displaceable manner thereon, and an eccentric to displace the cover plate with respect to the base plate. The base plate has in its central region at least one lower tang bent through 180 degrees whose lateral edges are supported at the inner lateral edges of tangs bent downwards through 180 degrees. The fastening plate formed in this way, unlike the prior art, has no back-cuts or undercuts. The secure hold and the light guidance for the transverse displaceability of the cover plate with respect to the base plate is ensured by the folded tangs which support one another at their edge regions. In this way, a low cost and symmetrical arrangment of a longitudinal mounting plate made of steel for the fastening of clip hinges is created which allows vertical adjustment by an eccentric.

Preferred embodiments of the invention can be found in the dependent claims following the main claim.

For instance, the shaft of the eccentric can penetrate a central longitudinally directed elongate aperture, whose width corresponds to the shaft diameter, in the web part of the cover plate and its lower, eccentric shaft part of a lower diameter can be pivoted in a central borehole of the base plate.

Further details and advantages of the invention can be seen in an embodiment shown in the drawing, which shows:

DETAILED DESCRIPTION OF THE PREFERRED EMBODIMENT

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
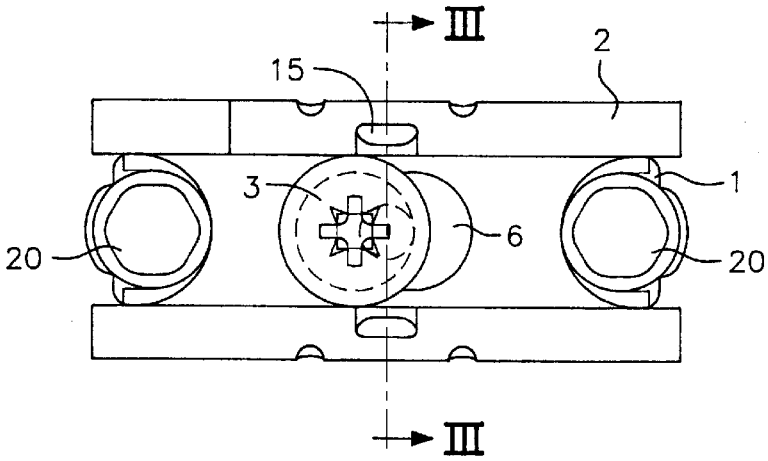
FIG. 1: a plan view of an embodiment of the fastening plate in accordance with the invention.
Figure 2:
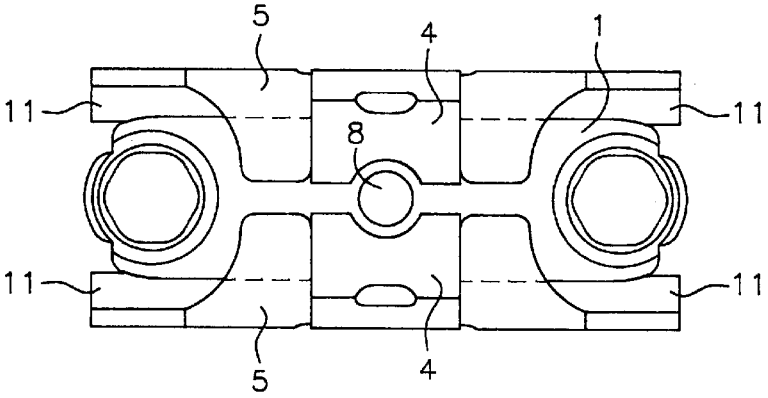
FIG. 2: a bottom view of the fastening plate in accordance with FIG. 1.
Figure 3:
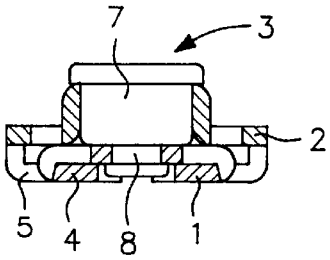
FIG. 3: a section in accordance with the section line III—III in FIG. 1.
Figure 4:
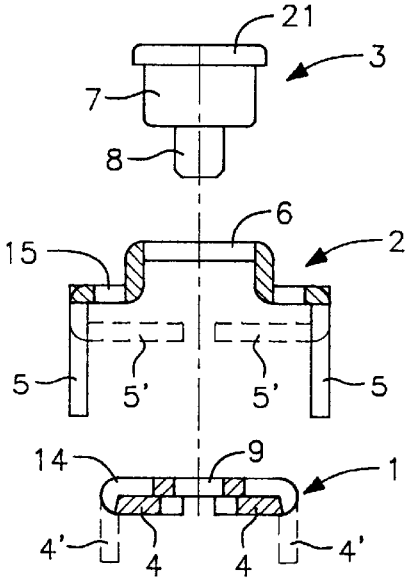
FIG. 4: the representation in accordance with FIG. 3, in which the individual components are drawn apart in an exploded view.

The fastening plate shown in the FIGS. 1 to 3 essentially consists of a base plate 1, a cover plate 2 and an eccentric 3. The simple manufacturing and mounting method based on the invention can be explained in particular by means of FIG. 4. The base plate 1 has lateral tangs 4' which are directed downwards and which are bent down into the final position 4 either before or during the assembly of all parts. The cover plate 2 is also provided on both sides with two separate tangs 5 directed downwards which are bent down into the position 5' while being put together so that they are located in the position best seen in FIG. 2. Finally, the eccentric 3 is inserted into the elongate aperture 6 such that its shaft 7 is supported at the edges of the elongate aperture. A lower eccentric shaft part 8 of the eccentric 3 is riveted into a borehole 9 of the base plate 1 so that the eccentric 3 is rotatably journalled in the borehole 9. The cover plate 2 is displaced with respect to the base plate 1 by turning the eccentric 3.

It can be seen in particular from FIG. 2 that the edges of the tangs 4 of the base plate 1 are supported at the inner edges of the tangs 5 of the cover plate 2 so that these tangs form a guide in the transverse direction. At the same time, the tangs 5 surround the base plate such that the cover plate 2 is held inseparably from the base plate 1, while its respective adjustment in the transverse direction can be carried out only by turning the eccentric 3 provided with a slot for a screwdriver. Appropriately, the elongate aperture 6 and the borehole 9 are located in the central region of the respective plates so that their design is symmetrical.

Figure 5:
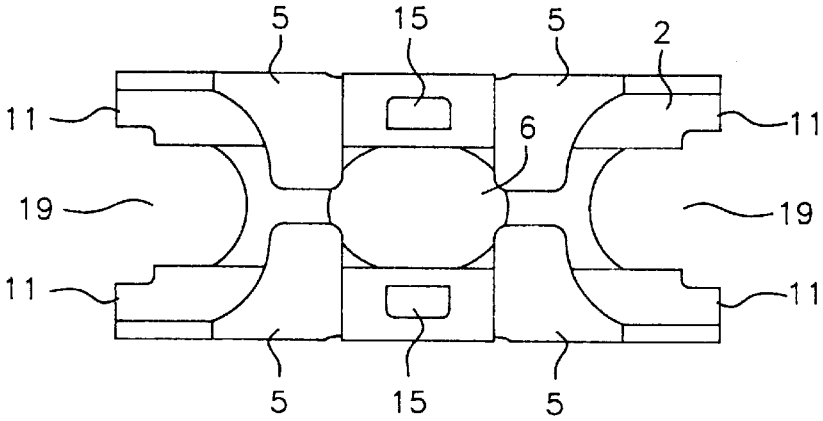
FIG. 5: a bottom view of the cover plate in accordance with the embodiment of FIG. 1.
Figure 6:
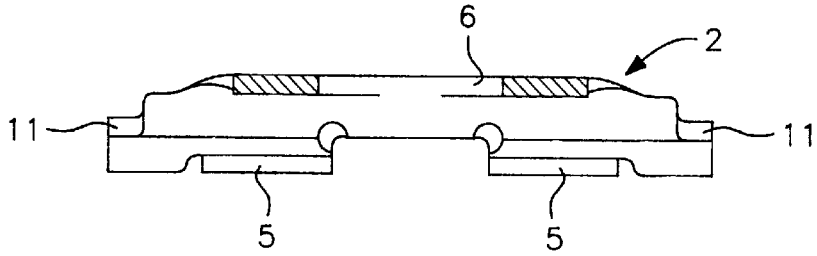
FIG. 6: a side view of the cover plate in accordance with FIG. 4.
Figure 7:
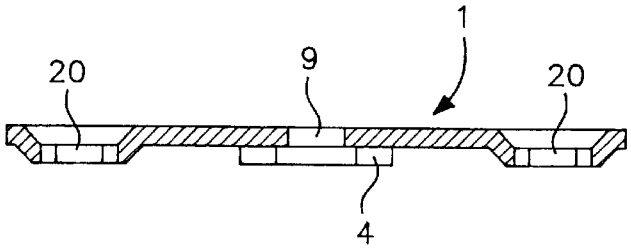
FIG. 7: a side view of the base plate of the embodiment of the fastening plate in accordance with FIG. 1.
Figure 8:
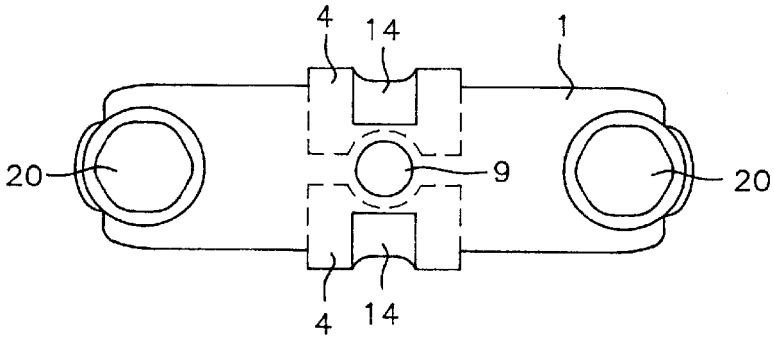
FIG. 8: a plan view of the base plate in accordance with FIG. 7.
Figure 9:
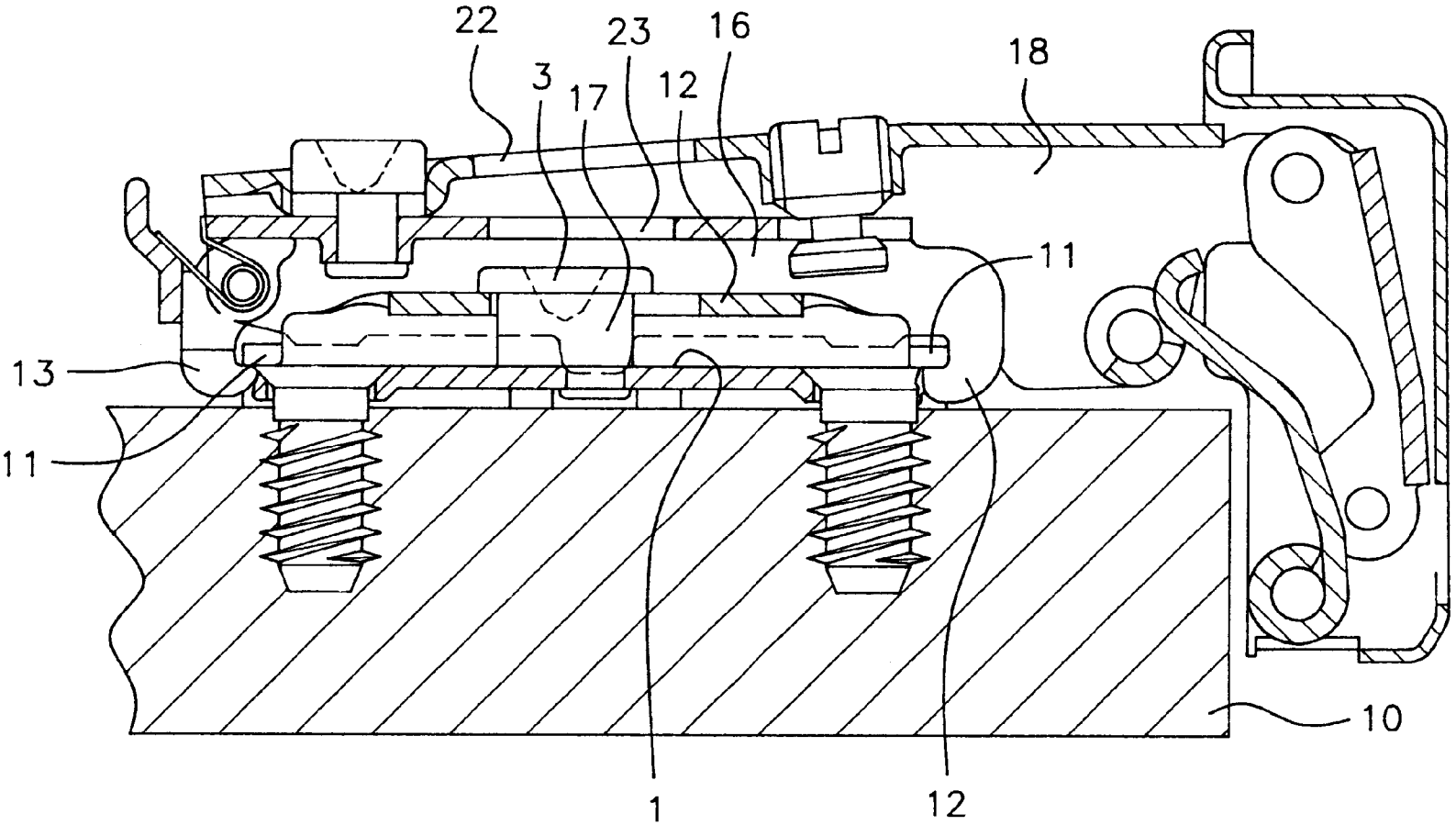
FIG. 9: a sectional representation of the fastening plate in accordance with FIG. 1 with an attached hinge arm of a furniture hinge, mounted at a carrier wall.

The base plate 1 and the cover plate 2 can be seen from the FIGS. 5 to 8, with FIG. 5 illustrating a bottom view of the cover plate 2, FIGS. 6 and 7 each illustrating a longitudinal section through both plates and FIG. 8 illustrating a plan view of the base plate 1. FIG. 9 shows a longitudinal section through the fastening plate with a mounted clip hinge fastened to a body side wall 10. The structure of the clip hinge is not looked at in any further detail here since it is known per se in the prior art. Reference is only made here to the fact that the end regions of the cover plate 2 are provided with lateral web parts 11 which serve the anchoring of both the front hooks 12 of an intermediate plate 16 of the hinge arm 18 and of a rear latch lever 13.

The base plate 1 is furthermore provided with recesses 14 and the cover plate 2 with slots 15 which serve in the mounted state to receive wedge-shaped extensions 17 provided centrally on the walls of the intermediate plate 16.

Finally, the base plate 1 is provided in a known manner with fastening boreholes 20 for fastening means which are accessible through recesses 19 of the cover plate 2.

The eccentric 3 can have a head 21 which can be actuated by a screwdriver by slots 22 or 23 respectively provided in the web part of the hinge arm 18 and the intermediate plate 16.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A fastening plate to fasten a hinge arm of a furniture hinge to a carrier wall, comprising:

an elongated base plate having at least two boreholes to receive fastening elements;

a cover plate covering the base plate at least in part and being guided in a transversely displaceable manner thereon, said cover plate having a pair of longitudinally spaced tangs bent down through 180 degrees; and an eccentric to transversely displace the cover plate with respect to the base plate;

said base plate having at a central region thereof at least one lower tang bent down through 180 degrees with lateral edges thereof being supported by inner lateral edges of said pair of longitudinally spaced tangs of the cover plate to provide said guidance for said transverse displacement of said cover plate on said base plate.

2. The fastening plate in accordance with claim 1, wherein the eccentric has a shaft that penetrates a central elongate aperture oriented in the longitudinal direction of the cover plate, a width of said elongate aperture corresponding to the diameter of the shaft, said eccentric further having an eccentric shaft part below the shaft which has a lesser diameter than the shaft, said eccentric shaft part being pivoted in a borehole centrally arranged in the base plate.

3. The fastening plate in accordance with claim 1, wherein the base plate has two laterally spaced tangs of substantially equal length in said central region.

4. The fastening plate in accordance with claim 1, wherein end regions of the cover plate are provided with lateral web parts which serve to anchor an attachable hinge arm.

5. The fastening plate in accordance with claim 1, wherein slots are recessed in the cover plate which serve to receive wedge-shaped extensions which are moulded on a furniture hinge to be fastened.

6. The fastening plate in accordance with claim 1, wherein the eccentric has a screw head which can be actuated by corresponding slots in an attached hinge arm.

7. The fastening plate in accordance with claim 1, wherein at least one of the base plate and the cover plate are designed symmetrically to their respective longitudinal and transverse central axes.

8. The fastening plate in accordance with claim 1, wherein said pair of longitudinally spaced tangs are bent around longitudinal edges of said base plate on either side of said at least one lower tang to substantially encircle said base plate.

9. A fastening plate to fasten a hinge arm of a furniture hinge to a carrier wall, comprising:

an elongated base plate for fastening to a carrier wall and having laterally spaced tangs thereon;

a cover plate covering the base plate at least in part and being guided in a transversely displaceable manner on said base plate by longitudinally spaced tangs positioned with respect to said base plate tangs so that lateral edges of said base plate tangs are in abutment with lateral edges of said cover plate tangs; and an eccentric to displace the cover plate transversely with respect to the base plate.

10. The fastening plate in accordance with claim 9, wherein said longitudinally spaced cover tangs are bent around longitudinal edges of said base plate to substantially encircle said base plate.

11. The fastening plate in accordance with claim 9, wherein the eccentric has a shaft that penetrates a central elongate aperture oriented in the longitudinal direction of the cover plate, a width of said elongate aperture corresponding to the diameter of the shaft, said eccentric further having an eccentric shaft part below the shaft which has a lesser diameter than the shaft, said eccentric shaft part being pivoted in a borehole centrally arranged in the base plate.

12. The fastening plate in accordance with claim 9, wherein said laterally spaced tangs include two base plate tangs of substantially equal length.

13. The fastening plate in accordance with claim 12, wherein said cover plate tangs and said base plate tangs are bent down through 180 degrees.

14. The fastening plate in accordance with claim 13, wherein said cover plate includes two pairs of longitudinally spaced tangs, one pair on each longitudinal edge of said cover plate such that the lateral edges of each base plate tang are abutted by inner lateral edges of one of said pairs of cover plate tangs.

15. The fastening plate in accordance with claim 9, wherein end regions of the cover plate are provided with lateral web parts which serve to anchor an attachable hinge arm.

16. The fastening plate in accordance with claim 9, wherein slots are recessed in the cover plate which serve to receive wedge-shaped extensions which are moulded on a furniture hinge to be fastened.

17. The fastening plate in accordance with claim 9, wherein the eccentric has a screw head which can be actuated by corresponding slots in an attached hinge arm.

18. The fastening plate in accordance with claim 9, wherein at least one of the base plate and the cover plate are designed symmetrically to their respective longitudinal and transverse central axes.

* * * * *